United States Patent [19]

Starr et al.

[11] 4,005,498

[45] Feb. 1, 1977

[54] PATIENT LIFTING DEVICE

[76] Inventors: Frank Starr; Jean Starr, both of N76 W14214 Appleton Ave., Menomonee Falls, Wis. 53051

[22] Filed: Jan. 19, 1976

[21] Appl. No.: 650,515

[52] U.S. Cl. ..... 5/81 R; 5/350; 5/369

[51] Int. Cl.[2] ..... A61G 7/08

[58] Field of Search ..... 5/61 R, 81 R, 368, 371, 5/369; 128/DIG. 20; 2/16, DIG. 3

[56] References Cited

UNITED STATES PATENTS

| | | | |
|---|---|---|---|
| 1,795,304 | 3/1931 | Howard | 5/368 |
| 2,655,369 | 10/1953 | Musilli | 5/368 |
| 3,026,541 | 3/1962 | Murat | 5/81 R |
| 3,331,087 | 7/1967 | Barlow | 5/81 R |
| 3,492,988 | 2/1970 | De More | 5/61 |
| 3,775,781 | 12/1973 | Bruno | 5/61 |
| 3,895,403 | 7/1975 | Davis | 5/61 |
| 3,935,604 | 2/1976 | Collins | 5/61 |

*Primary Examiner*—Paul R. Gilliam
*Assistant Examiner*—Kenneth J. Dorner
*Attorney, Agent, or Firm*—Haight, Hofeldt, Davis & Jambor

[57] ABSTRACT

An inflatable patient lifting device for a hospital patient. The disclosure includes an inflatable pad having a control pocket formed thereon for receiving a hospital attendant's arm. In use the pad is inserted underneath the patient with the control pocket and attendant's arm being positioned above the inflatable pad and in contact with the patient's body.

6 Claims, 7 Drawing Figures

PATIENT LIFTING DEVICE

BACKGROUND OF THE INVENTION

Lifting and moving immobilized hospital patients has long presented problems to nurses and hospital staff attendants. The problem is acute when the patient is heavy or where his condition is so extreme as to eliminate the possibility of the patient's assistance or muscular control. Thus, the turning of patients in intensive care units to avoid bed sores or the lifting of immobilized patients upon a bed pan requires strenuous exertion by one or more hospital staff attendants. Moreover, this strenuous exertion is from alongside the hospital bed — a position which further aggravates the problem in that it is most awkward to maximize one's lifting force against a patient positioned transversely away from the staff attendant.

Numerous inflatable devices for turning or lifting a patient have been suggested by the prior art. Such devices involve an inflatable tube adapted to be first placed under the patient and then inflated by a hand pump, or other source of compressed air, to raise the patient. Many of these prior devices are disclosed in the following patents:

| | |
|---|---|
| 1,981,666 Ridley | 3,331,087 Barlow |
| 2,618,269 Baum et al. | 3,332,415 Erickson |
| 3,026,541 Murat | 3,526,908 Davis |
| 3,178,732 Stibitz | 3,775,781 Bruno et al |
| 3,242,923 Jacoby, Sr. | 3,795,021 Moniot |
| 3,245,405 Gardner | 3,895,403 Davis |

Such art includes inflatable units which may be complex in manufacture or difficult to control. Such a control problem may result from the fact that the inflatable device first expands in areas displaced from the weight of the patient — in the area of least resistance. Such expansion can further result in undesired turning of the patient or in an expansion of the device in an area which makes uniform lifting impossible.

SUMMARY OF THE INVENTION

To overcome the disadvantages of the prior art and to facilitate both lifting and movement of the patient, the instant invention includes an inflatable device combined with a control means which receives the arm of the attendant. Preferably, this control means takes the form of a pocket or tube mounted on top of the inflatable device. In use, the attendant inserts his arm into the control pocket and then slips the entire unit underneath the patient, such that the control pocket and attendant's arm are on top of the inflatable device and in contact with the patient's body. Thus, with the attendant's arm underneath the patient, air is forced into the inflatable unit elevating the attendant's arm together with the patient. By reason of this design, the attendant has "feel" of the patient's body movement during inflation of the device and elevation and raising of the patient. Moreover, this "feel" provides immediate detection and appreciation by the attendant of undesired movement of the patient such as rolling rather than vertical lifting. Moreover, this early appreciation enables the attendant to apply force through his arm upon a section of the inflatable device, resulting in faster inflation at other areas. Accordingly, by sensing unwanted movement of the patient, the attendant, with little downward force, can control the vertical raising of the patient or other desired movements.

Accordingly, it is an object of our invention to provide an inflatable patient lifting device which provides full sensing and control of the patient's movement during elevation. Another object is to provide a lifting device which is simple, low in cost, easily cleaned and which minimizes the physical exertion by hospital attendants in moving patients.

DESCRIPTION OF THE DRAWINGS

The manner in which these and other objects of the invention are obtained will be made clear with reference to the following specification and drawings in which:

FIG. 2 is a perspective view as in FIG. 1 depicting the invention in use in lifting a patient;

DETAILED DESCRIPTION

Figure 1:
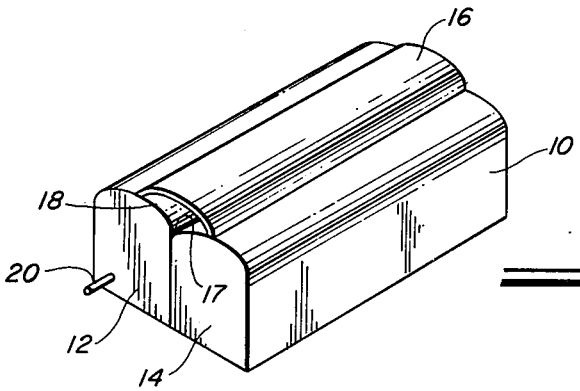
FIG. 1 is a perspective view of a preferred embodiment of our invention in its inflated position.
Figure 2:
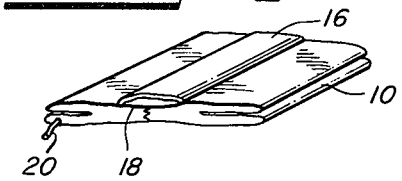
FIG. 2 is a perspective view as in FIG. 1 depicting the invention in its deflated position.

As shown in FIGS. 1 and 2, the preferred embodiment of our invention is a dual compartment inflatable device 10. These compartments 12 and 14 are generally rectangular tubes joined together to present a flat bottom for maximizing stability. The device 10 may be formed of nylon fabric which is preferably double coated with polyurethane. Alternatively, vinyl plastic or elastomeric materials may be used. In manufacture, patterns to form the desired structure are cut from the selected material with the edges preferably being heat sealed into the tubular shape depicted. Such patterns may take one of several forms but should be cut to result in the shape depicted while minimizing waste material. Preferably, the top of each compartment is dual shape so as to define a longitudinal recess at their juncture as shown. If the compartments are separately formed, they may then be joined together by heat sealing, the adjacent side walls being pierced to provide free flow of air between compartments 12 and 14.

Subsequently, a separate sheet of material is attached along its two edges to the top of each compartment near its longitudinal centerline. When joined, the sheet 16 together with the covered portion or longitudinal recess at the juncture of the tubular compartments 12 and 14 forms a control pocket 18 into which the attendant may insert his arm.

Figure 3:
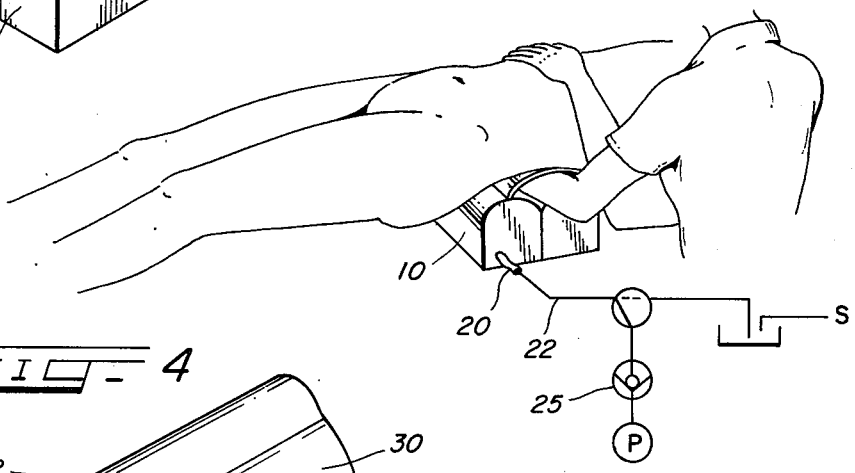

In use, the attendant inserts his arm into section 18 with the unit deflated and then urges the entire unit underneath the patient as shown in FIG. 3. Then, air may be forced into the two compartments 12 and 14 through a fitting 20 which is connected to one of the compartments.

One preferred source of air pressure is a pump (P) connected to conduit 22. Controlling the flow of air is a two position rotary valve 24 and a one-way check valve 25. In use, the electrically operated pump may be actuated by a foot pedal and switch (not disclosed) to force air into the inflatable compartments 12 and 14 which should have interconnecting air passages to permit simultaneous inflation. During inflation, the attendant can control the volumetric expansion of the unit to insure vertical turning or lateral movement of the patient. Such vertical or turning control is effected by downward pressure applied either by the hand or elbow of the attendant. Such downward pressure over an area smaller than that of the patient's body will cause the opposite end of the bag to inflate at a faster rate. Alternatively, the device may be used to move the patient towards the head or foot of the bed by the attendant's arm movement in that direction. During inflation such affects a rolling action of the bag. Deflation of the unit is effected by rotating the valve 24 to connect it to the atmosphere or sump (S).

Figure 4:
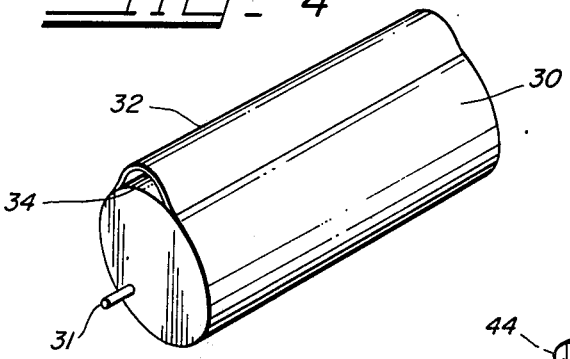
FIG. 4 is a perspective view of another preferred embodiment of our invention.

An alternative device 30 which may better assist lateral movement of the patient is shown in FIG. 4. This unit, formed of materials similar to that of the first embodiment, is annular in cross section and has its ends closed to form an air-tight inflatable tube having a fitting 31 for attachment to conduit 22. Along the top is secured a panel 32 in a manner to define a control pocket 34 similar to that of the embodiment of FIGS. 1 and 2. The operation of this embodiment is also similar to that of FIGS. 1 and 2 with the exception that upon inflation, it facilitates rolling action which can be used to move the patient towards either end of the bed.

Figure 5:
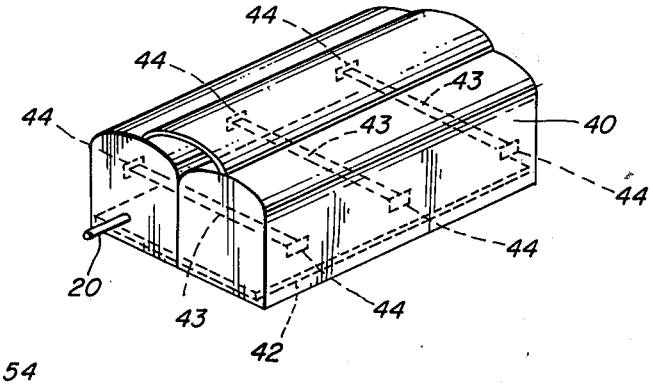
FIG. 5 is a perspective view of a modification of the embodiment of FIG. 1, showing additional elastic cross members and a rigid base section.

Another alternative configuration 40, which provides automatic and rapid collapse of the device into a size and shape convenient for storage, is illustrated in FIG. 5. This modification utilizes the lifting device of FIG. 1 but with two additional features. The first consists in providing a relatively inflexible base plate 42 as shown in FIG. 5. This may be accomplished by attaching a rigid, thin rectangular material to the base portion of the device or by using a rigid material as the base portion itself. The function of this rigid base member is to maintain the base in its rectangular shape upon collapse of the fluid envelope.

Figure 6:
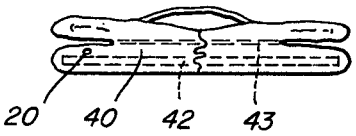
FIG. 6 is a side elevational view as in FIG. 5 depicting the invention in its deflated position.

The second feature consists of straps 43 of elastic material as in FIG. 5, preferably three in number, the ends of which are fastened to opposite vertical walls mid-way between top and bottom, as at points 44 in FIG. 5. The straps traverse the inner space of the device and are in a tensed condition with the envelope is inflated. Upon deflation, the reduction in outward pressure against the vertical walls allows the straps to compress to a more relaxed condition, thereby pulling the mid-portions of the opposite vertical walls toward each other. This results in the device's autonomous assumption of a folded, compact compartment upon deflation as shown in FIG. 6.

Figure 7:
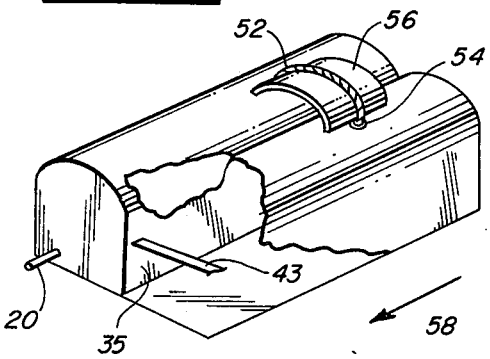
FIG. 7 is a perspective view of a modification of the embodiment of FIG. 5 with portions broken away.

A still further alternative configuration is that of FIG. 7, which provides the addition of a handle to facilitate removal of the device from beneath the patient. This modification takes any of the other configurations mentioned and adds to them a rope or strap over the control panel which is securely fastened at points 52 and 54 as in FIG. 7. With this addition, the control panel may be of the full length of the device as in FIG. 1, or of lesser length as in FIG. 7. This additional rope or strap is beneficial in removing the device since the central panel 56 will ordinarily be too large for grasping and, if not too large, the points of attachment of the panel to the lifting device may be of insufficient strength to withstand tearing when the removing force is applied to it as in the direction of the arrow 58 in FIG. 7. Of course, it is contemplated that this modification can be accomplished by making the points of attachment of the control panel strong enough to eliminate the need for the rope handle.

Several modifications can be made to any of the embodiments. A hand pump or a container of compressed air may be used as a source of fluid pressure. Too, a less expensive embodiment would utilize two or more straps in lieu of the panels 16 and 32 for receiving the attendant's arm to sense patient movement and to effect control. One or more of these straps may be firmly anchored to eliminate the need for the rope of FIG. 7. A similar recess could be formed in the embodiment of FIG. 4. Although not preferred, elastic materials such as rubber could be utilized in making the inflatable device. In the event that compartments 12 and 14 are separately made, they will have a common sidewall 35 which should be pierced to provide free flow of air between the compartments and to permit the attachment of the straps 43.

We claim:

1. An inflatable device for lifting hospital patients comprising:

a. an elongated inflatable pad having a generally flat bottom section and a top section having a longitudinal recess; said bottom section and said top section being interconnected by sidewalls;

b. a source of fluid pressure;

c. conduits interconnecting the source of fluid pressure to said inflatable pad; and d. a control panel affixed to said top section of said pad and covering said longitudinal recess, said control panel and said recess defining a control pocket, said control pocket being open ended on at least one end for receiving an attendant's arm, inflation of said pad applying a lifting force to the attendant's arm and to the patient for facilitating control of a hospital patient during inflation of said pad.

2. An apparatus as recited in claim 2 in which said device includes two compartments attached together to define said inflatable pad, said compartments being interconnected by passages to permit air flow therebetween, said recess extending along the juncture of said two compartments.

3. An apparatus as recited in claim 2 in which said sidewalls are interconnected by elastic means for collapsing said pad.

4. An apparatus as recited in claim 3 in which said inflatable pad includes:

a. a fluid conduit connected to the patient lifting device;

b. a source of fluid pressure; and c. a valve connecting said conduit to said pressure source which is selectively capable of permitting any of the following: fluid flow only in the direction from the pressure source to the connecting means; fluid flow only in the direction from the connecting means into the atmosphere; and no fluid flow at all to or from the connecting means.

5. A fluid operated inflatable device for lifting hospital patients comprising:

a. an inflatable elongated envelope, formed of a fluid-impervious material, to define a generally flat bottom section, vertical side sections, and a top section having a depression running in the direction of elongation;

b. a control panel covering at least a part of said depression and fastened to the top section, the panel and top section forming a sleeve on top of said envelope for accepting an attendant's arm to control the movement of the patient during lifting, said sleeve being open ended on at least one end; and c. a source of fluid pressure connected to the envelope.

6. An apparatus as recited in claim 5 in which the depression of the top section is formed by connecting means extending internally from the top section to the bottom section, said connecting means defining generally two internal compartments between which free fluid flow is uninhibited.

* * * * *